US008294625B2

(12) United States Patent
Kittinger et al.

(10) Patent No.: US 8,294,625 B2
(45) Date of Patent: Oct. 23, 2012

(54) ANTENNA DIVERSITY SYSTEM

(75) Inventors: Gregg R. Kittinger, Pontiac, MI (US); Donald B. Hibbard, Jr., Howell, MI (US); David J. Trzcinski, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 451 days.

(21) Appl. No.: 12/700,515

(22) Filed: Feb. 4, 2010

(65) Prior Publication Data

US 2011/0187613 A1 Aug. 4, 2011

(51) Int. Cl.
*H01Q 1/32* (2006.01)

(52) U.S. Cl. ..... 343/713; 343/711

(58) Field of Classification Search ..... 343/711, 343/712, 713, 715, 900
See application file for complete search history.

(56) References Cited

U.S. PATENT DOCUMENTS

| | | | | |
|---|---|---|---|---|
| 6,606,059 | B1 * | 8/2003 | Barabash | 343/700 MS |
| 6,927,736 | B1 * | 8/2005 | Kornbau et al. | 343/712 |
| 8,144,061 | B2 * | 3/2012 | Sakuma | 343/700 MS |
| 2005/0052334 | A1 * | 3/2005 | Ogino et al. | 343/866 |
| 2011/0128206 | A1 * | 6/2011 | Wakabayashi | 343/860 |

* cited by examiner

*Primary Examiner* — Hoanganh Le

(57) ABSTRACT

An antenna of the present invention includes an electrical half wave monopole antenna element fixedly attached to a surface, where the antenna element includes an electrical center. A first electrical feed point is located on a first side of the antenna element. A second electrical feed point is located on a second side of the antenna element. The second side generally opposes the first side of the antenna element. The first and second electrical feed points are about one-twentieth a wavelength from the electrical center. A first signal corresponds with the first electrical feed point and a second signal corresponds with the second electrical feed point. The first signal is out of phase when compared to the second signal.

20 Claims, 4 Drawing Sheets

ANTENNA DIVERSITY SYSTEM

FIELD

The present disclosure relates to a diversity antenna system, and more particularly to a diversity antenna system including a single antenna element.

BACKGROUND

The statements in this section merely provide background information related to the present disclosure and may or may not constitute prior art.

Radio signals can vary in received strength depending on factors such as the distance between the radio transmitter and receiver, as well as the type of environment that the radio signal travels through. In an effort to improve radio signal quality, some vehicle radio systems employ several different antennas in a diversity system that selects the antenna providing the strongest signal. As a result, vehicles typically include several different antennas to receive radio signals. However, having multiple antennas visible on the exterior of the vehicle may not always be aesthetically pleasing and can cause styling issues.

One approach to conceal multiple antennas on a vehicle is to place the antennas in either the windshield or the rear glass of the vehicle. However, this approach may no longer be an option because of some types of regulatory standards that restrict the use of the windshield due to window glazing requirements, or require metalized rear glass that would interfere with antenna reception. Moreover, if the vehicle is a convertible where the roof can retract and fold away, the rear glass will be lowered when the roof is retracted, thereby affecting antenna reception.

While current diversity antenna systems achieve their intended purpose, there is a need for a new and improved diversity antenna system which exhibits improved performance from the standpoint of appearance.

SUMMARY

The present invention provides an antenna configured to mount to a surface, including an electrical half wave monopole antenna element fixedly attached to a surface. The antenna element includes an electrical center, a first electrical feed point and a second electrical feed point. The first electrical feed point is located on a first side of the antenna element, and the second electrical feed point is located on a second side of the antenna element. The second side generally opposes the first side of the antenna element. The first and second electrical feed points are located about one-twentieth a wavelength from the electrical center. A first signal corresponds with the first electrical feed point and a second signal corresponds with the second electrical feed point. The first signal is out of phase when compared to the second signal.

In an embodiment of the present invention, the phase difference between the first signal and the second signal is about ninety degrees.

In another embodiment of the present invention, the antenna element includes a third electrical feed point that is located at about the electrical center of the antenna element.

In yet another embodiment of the present invention, the first electrical feed point and the second electrical feed point are FM feed ports and the third electrical feed point is an AM feed point.

In an embodiment of the present invention, the antenna element is configured to be affixed to one of a rear spoiler, a cowl lip, and a fascia of a vehicle.

In another embodiment of the present invention, the electrical center of the antenna element is located at about a midpoint of the antenna element. The electrical center is also a mechanical center of the antenna element.

In an embodiment of the present invention, a diversity antenna system includes an electrical half wave monopole antenna element fixedly attached to a surface and a diversity combiner. The antenna element includes an electrical center, a first electrical feed point and a second electrical feed point. The first electrical feed point is located on a first side of the antenna element, and the second electrical feed point is located on a second side of the antenna element, The second side generally opposes the first side of the antenna element. The first and second electrical feed points are located about one-twentieth a wavelength from the electrical center. A first signal corresponds with the first electrical feed point and a second signal corresponds with the second electrical feed point. The first signal is out of phase when compared to the second signal. The diversity combiner is in communication with both of the first signal and the second signal. The diversity combiner combines the first signal and the second signal together to create a single antenna signal.

In an embodiment of the present invention, the single antenna signal is created by selecting a maximum gain value between the first signal and the second signal, where the single antenna signal includes the maximum gain value.

In another embodiment of the present invention, the phase difference between the first signal and the second signal is about ninety degrees.

In yet another embodiment of the present invention, the antenna element includes a third electrical feed point that is located at about the electrical center of the antenna element.

In an embodiment of the present invention, the first electrical feed point and the second electrical feed point are FM feed ports that correspond with an FM signal, and the third electrical feed point is an AM feed point that corresponds with an AM signal.

In another embodiment of the present invention, the diversity combiner is in communication with a switching antenna amplifier that selects one of the AM signal and the FM signal.

In yet another embodiment of the present invention, the switching antenna amplifier is in communication with an AM/FM receiver.

In an embodiment of the present invention, the diversity combiner is integrated with an AM/FM receiver.

In another embodiment of the present invention, the AM/FM receiver includes an antenna selection circuit.

In an embodiment of the present invention, the antenna element is configured to be affixed to one of a rear spoiler, a cowl lip, and a fascia of a vehicle.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1A:
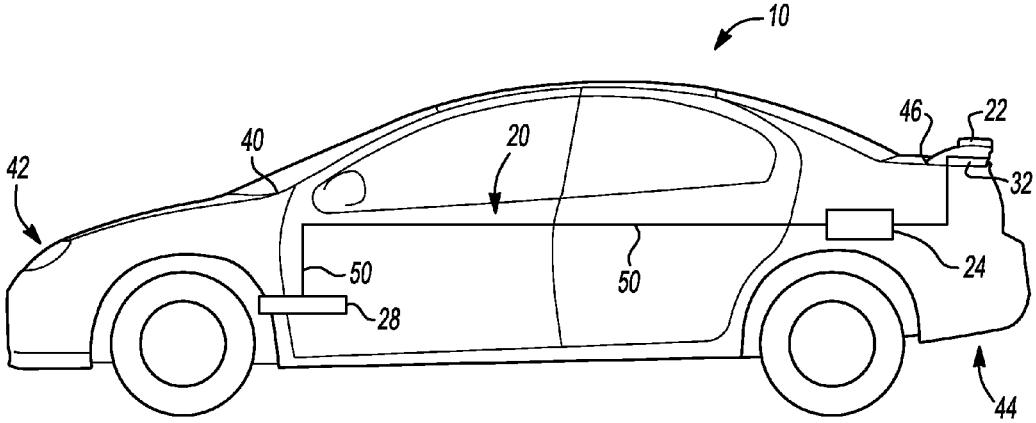
FIG. 1A is a side view of a vehicle including an exemplary antenna diversity system including an antenna element.
Figure 1B:
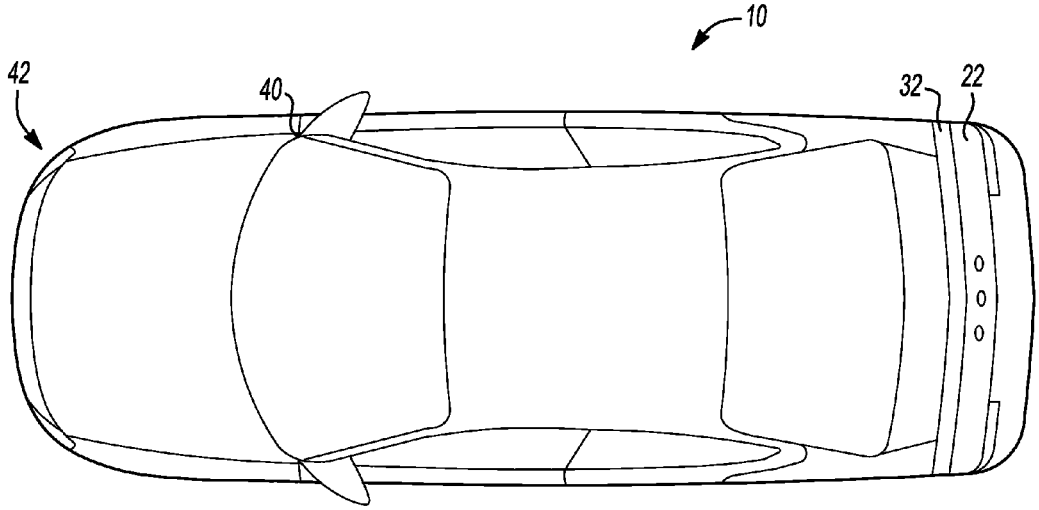
FIG. 1B is a top view of the vehicle illustrated in FIG. 1A.

With reference to FIG. 1A, a side view of a vehicle is generally indicated by reference number 10 and includes a diversity antenna system 20 for receiving radio frequency (RF) signals. The diversity antenna system 20 includes an electrical antenna element 22 that is configured to mount to a surface. In the embodiment as shown, the antenna element 22 is fixedly attached to a surface of the vehicle 10. The diversity antenna system 20 also includes a diversity antenna module 24 and an AM/FM receiver 28. Referring to FIGS. 1A-1B, the antenna element 22 is a plate antenna having an elongated shape and a flattened profile, and is positioned along the length of a rear spoiler 32 of the vehicle 10. Although the antenna element 20 is illustrated positioned on the spoiler 32, it is understood that the antenna element 22 can be positioned in other portions of the vehicle 10 as well. For example, the antenna element 22 can also be positioned along the length of a cowl lip 40. Alternatively, in another embodiment the antenna element 22 could also be positioned along either the front fascia 42 or the rear fascia 44 of the vehicle 10. Moreover, although the antenna element 22 is illustrated on an exterior surface 46 of the spoiler 32, the antenna element 22 can also be placed within the spoiler 32 as well.

Referring to FIG. 1A, the antenna element 22 is in communication with the diversity antenna module 24 through an electrical connection 50. The diversity antenna module 24 is in communication with the AM/FM receiver 28 through the electrical connection 50 as well. The electrical connection 50 may be any type of transmission line for carrying radio frequency signals such as, for example, coaxial cable. Although FIG. 1A illustrates the diversity antenna module 24 and the AM/FM receiver 28 as separate components, it should be noted that the diversity antenna module 24 and the AM/FM receiver 28 can also be integrated, and is illustrated below in FIG. 4.

Figure 2:
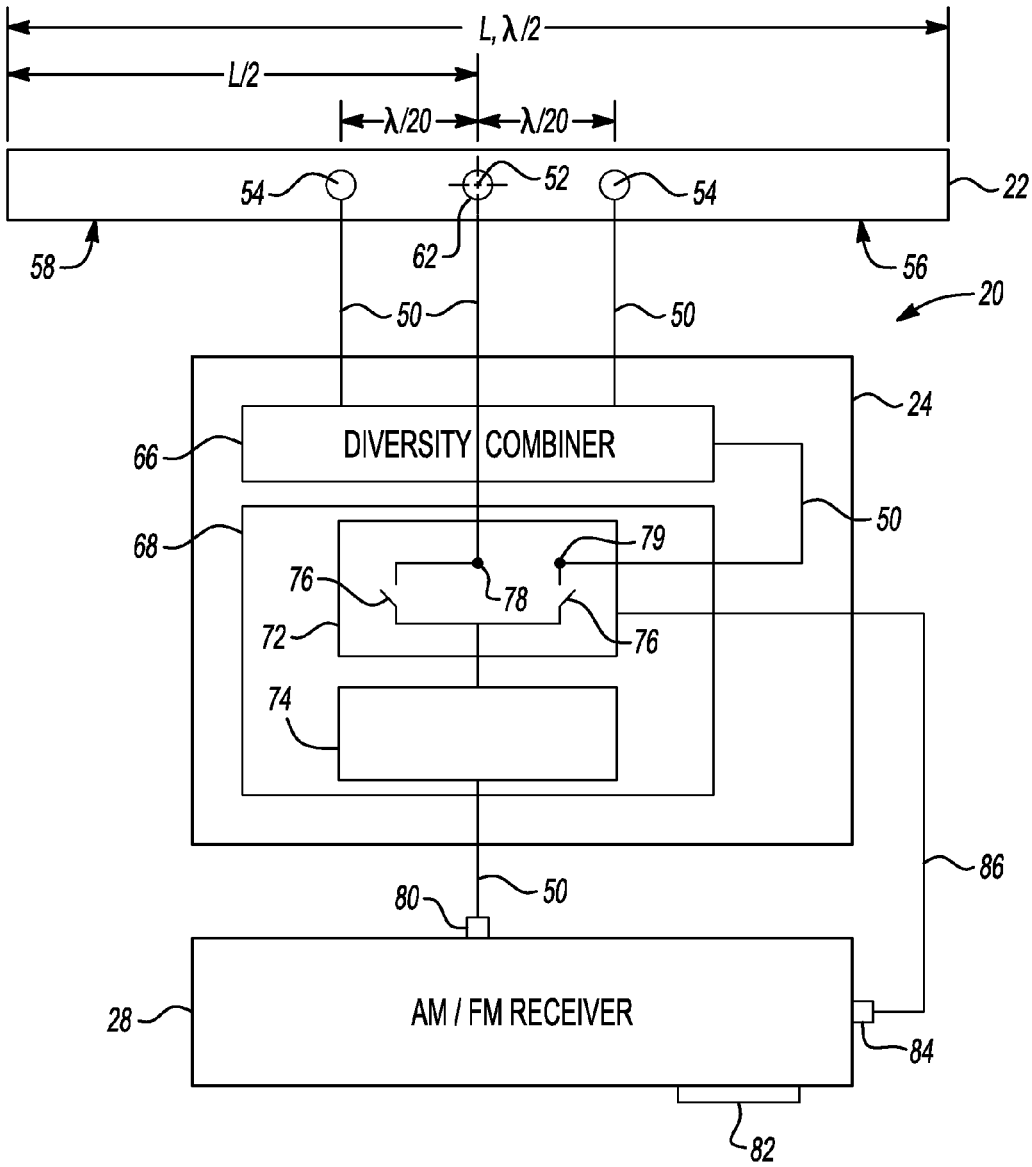
FIG. 2 is a schematic illustration of the antenna diversity system illustrated in FIG. 1A.

FIG. 2 is a schematic illustration of the diversity antenna system 20. The antenna element 22 is a half wave monopole antenna element for receiving RF signals, and has an electrical length that is approximately half a wavelength ($\lambda/2$). In the embodiment as illustrated, the antenna element 22 receives frequency modulated (FM) and amplitude modulated (AM) signals. However, it is understood that the antenna element 22 may also be configured to receive other types of RF signals as well as long as the RF signals are of a higher frequency than AM or FM signals. Specifically, a mechanical length L of the antenna element 22 can be adjusted accordingly to match the particular wavelength of the RF signal being received, while still maintaining the electrical length of half a wavelength ($\lambda/2$). For example, the mechanical length L of the antenna element 22 could be adjusted accordingly for receiving satellite radio signals as well.

In the embodiment as illustrated, an electrical center 52 is located at approximately at a midpoint along the electrical length $\lambda/2$ of the antenna element 22. In the embodiment as illustrated, the electrical center 52 of the antenna element 22 is located at a distance L/2 that is about half the mechanical length L of the antenna element 22, at the mechanical center of the antenna element 22. However, one of skill in the art will appreciate that the electrical center 52 is not always located at the mechanical center of the antenna element 22.

The antenna element 22 receives AM and FM signals, and includes two FM feed points 54. One of the FM feed points 54 is located on a first side 56 of the antenna element 22, and the other FM feed point 54 is located on a second side 58 of the antenna element 22. The first side 56 of the antenna element 22 generally opposes the second side 58 of the antenna element 22, and the two FM electrical feed points 54 are located at about one-twentieth ($\lambda/20$) a wavelength from the electrical center 52. The antenna element 22 also includes an AM feed point 62 for receiving the AM RF signals. The AM feed point 62 is located at about the electrical center 52 of the antenna element 22.

Each of the FM feed points 54 allow for the acquisition of a separate FM RF signal, where a first signal corresponds with one of the FM electrical feed points 54, and a second signal corresponds with the other FM electrical feed point 54. It should be noted that while each FM feed point 54 includes a separate signal; both of the signals each originate the same radio transmittal. That is, the first signal and the second signal both represent the same radio transmittal, but the first signal is out of phase when compared to the second signal. Specifically, the phase difference between the first signal and the second signal is about ninety degrees (90°), which is caused by each FM feed point 54 being positioned at about one-twentieth ($\lambda/20$) a wavelength from the electrical center 52. The AM feed point 62 also allows for the acquisition of a separate AM signal as well.

Figure 4:
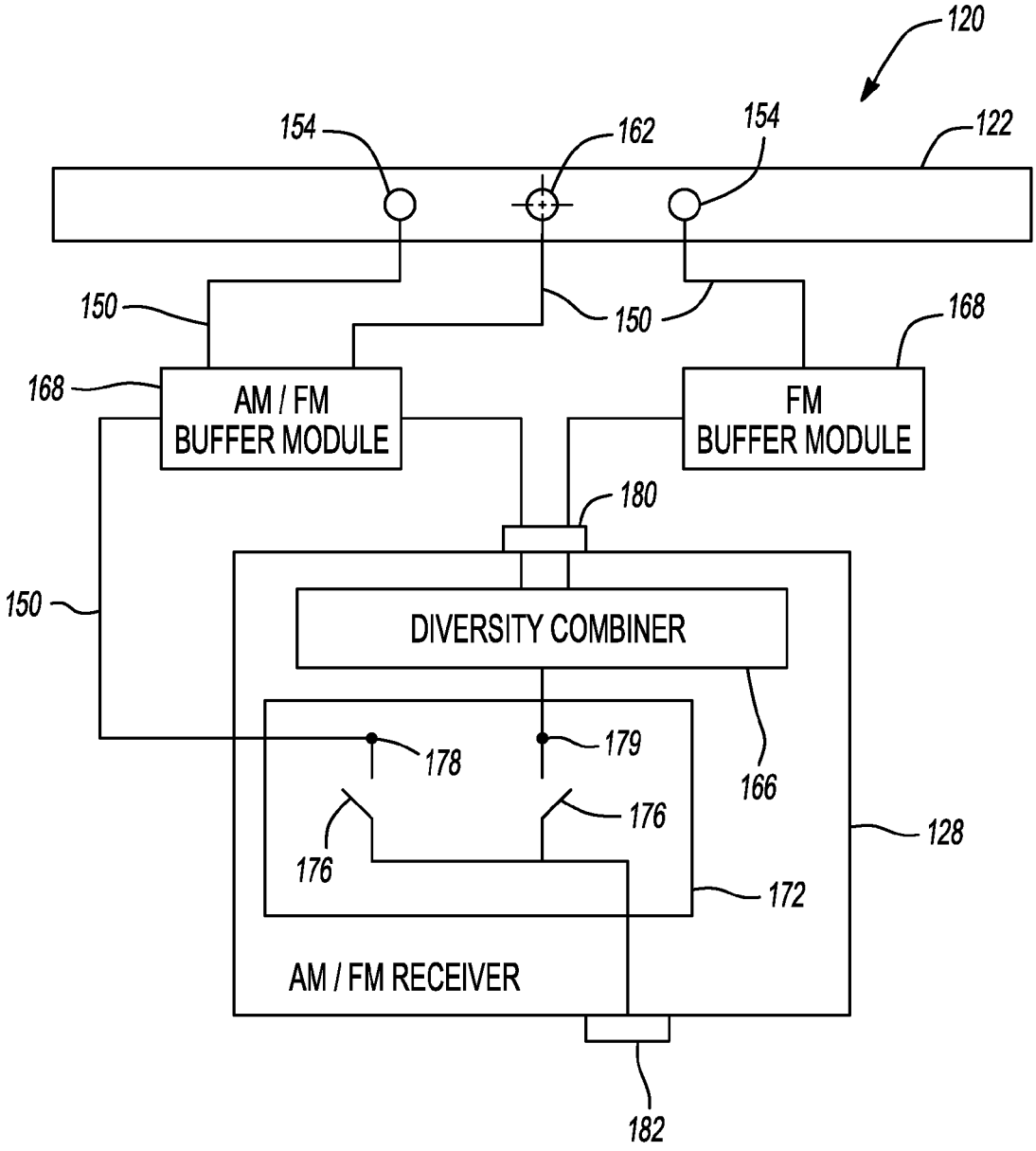
FIG. 4 is an alternative embodiment of the antenna diversity system illustrated in FIG. 2.

The electrical connection 50 connects each of the FM feed points 54 as well as the AM feed point 62 to the diversity antenna module 24. Alternatively, in another embodiment the FM feed points 54 and the AM feed point 62 are directly connected to the receiver via an antenna amplifier, and is illustrated in FIG. 4. The diversity module 24 includes a FM diversity combiner 66 as well as an AM/FM antenna amplifier 68. The FM feed points 54 are connected to the FM diversity combiner 66, and the output of the FM diversity combiner 66 and the AM feed point 62 are each connected to an AM/FM antenna amplifier 68. The diversity combiner 66 receives the first signal and the second signal from the FM feed points 54 and combines the signals into a single antenna signal, where the resultant signal is a composite of the first signal and the second signal.

The diversity combiner 66 is any device that includes circuitry or control logic for combining two or more RF signals that each originate from the same radio transmittal. The diversity combiner 66 includes a processing module and associated memory used to store data. The processing module can include a microprocessor, digital signal processor, logic circuitry, analog circuitry, digital circuitry, or any other type of device that combines two different RF signals. One commercially available example of a diversity combiner is the Audio Signal Processor AN00001 manufactured by NXP Semiconductors, located in Eindhoven, The Netherlands.

Figure 3A:
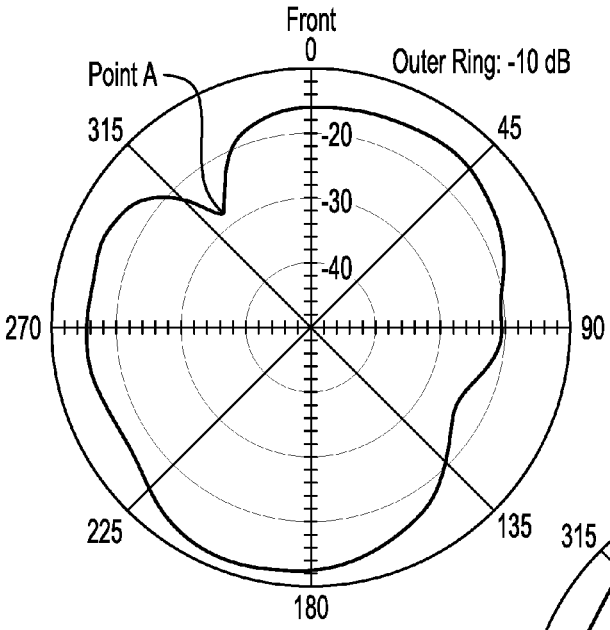
FIG. 3A is a polar plot illustrating an exemplary antenna gain pattern obtained by a first FM feed point of the antenna element illustrated in FIG. 1A.
Figure 3B:
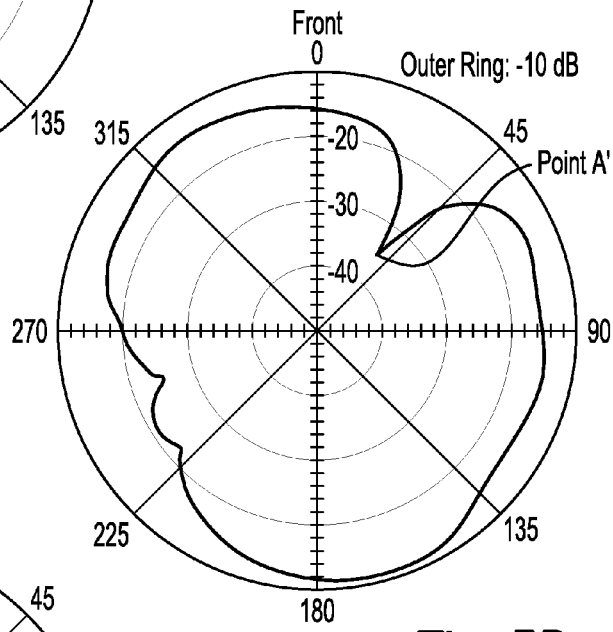
FIG. 3B is a polar plot illustrating an exemplary antenna gain pattern obtained by a second FM feed point of the antenna element illustrated in FIG. 1A.
Figure 3C:
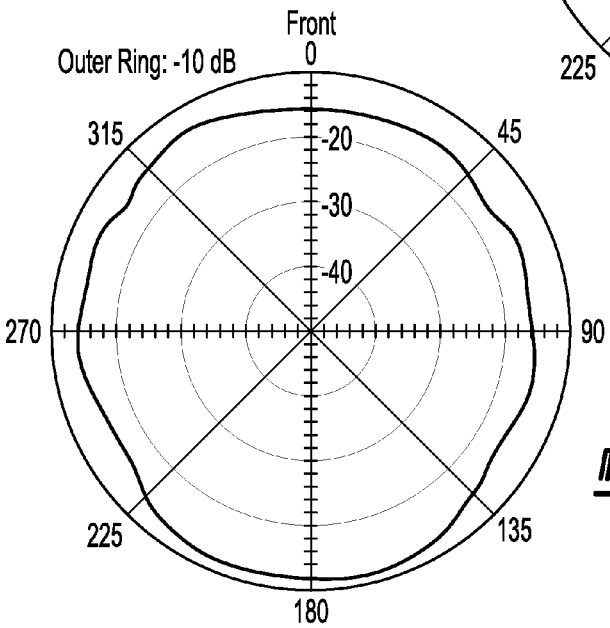
FIG. 3C is a polar plot illustrating an exemplary antenna gain pattern obtained by combining both of the antenna gain patterns in FIGS. 3A-3B.

FIGS. 3A-3C are polar plots illustrating antenna gain patterns for the first signal, the second signal and the single antenna signal of the antenna element 22 that is positioned on an exemplary vehicle 10. The antenna gain illustrated is the best value selected from vertically polarized energy and horizontally polarized energy of the antenna signal. FIG. 3A is a polar plot illustrating an exemplary antenna gain pattern for the first signal, FIG. 3B is a polar plot illustrating an exemplary antenna gain pattern for the second signal, and FIG. 3C is a polar plot illustrating an exemplary antenna gain pattern for the single antenna signal that is a composite of both the first signal with the second signal. Antenna gain measures the signal strength of the antenna, and is measured in decibels (dB). A higher decibel value means a higher gain value, where a higher gain value results in improved signal quality.

The diversity combiner 66 (FIG. 2) uses a maximum gain combining technique to combine the gain patterns of first signal with the second signal, which results in the single antenna signal illustrated in FIG. 3C. As seen in each of FIGS. 3A-3C, a region of lower gain on the first signal corresponds with a region of higher gain on the second signal, and a region of lower gain on the second signal corresponds with a region of higher gain on the first signal. This is caused by the ninety degree phase difference between the gain pattern of the first signal (FIG. 3A) and the gain pattern of the second signal (FIG. 3B). For example, Point A located on the gain pattern of the first signal illustrated in FIG. 3A generally corresponds with Point A' on the gain pattern of the second signal illustrated in FIG. 3B. Point A on the first signal is located at approximately three hundred and fifteen degrees (315°) on the polar axis, while Point A' is shifted about ninety degrees from point A and is located at approximately forty-five degrees (45°) on the polar axis.

Point A and Point A' each represent an area that has a relatively low gain value when compared to the rest of the gain pattern. However, the single antenna signal illustrated in FIG. 3C does not include the relatively low gain value of either Point A or Point A'. Referring to the gain patterns illustrated in FIGS. 3A-3B, at Point A located at approximately three hundred and fifteen degrees (FIG. 3A), the diversity combiner 66 selects the higher gain value that is associated second signal (FIG. 3B). At Point A' located at approximately forty-five degrees (FIG. 3B), the diversity combiner 66 selects the higher gain value that is associated with the first signal (FIG. 3A). Therefore the first and second signals are combined such that the gain of the single antenna signal is always the higher gain value of the first and second signals, resulting in an improved signal that has better reception quality than any individual antenna signal received from the FM feed points 54.

Referring back to FIG. 2, the single antenna signal from the diversity combiner 66 and the AM RF signal from the AM feed point 62 are each sent to the AM/FM antenna amplifier 68 through the electrical connection 50. The AM/FM antenna amplifier system 68 includes an antenna selecting circuit 72 for switching between the AM and the FM signals and an amplifier 74. In the embodiment as illustrated, the circuitry of the antenna selecting circuit 72 includes two switches 76 that are applied to respective input terminals 78, 79 of the AM and FM signals. The antenna selecting circuit 72 selects one of the AM and FM signals and sends the selected signal to the amplifier 74. Although FIG. 2 illustrates the antenna selecting circuit 72 including two switches for selecting a signal, the antenna selecting circuit 72 can include a microprocessor, digital signal processor, logic circuitry or any other type of device that can select between two different RF signals. The amplifier 74 includes circuitry for amplifying the signal selected by the antenna selecting circuit 72 to a predetermined level.

The amplifier 74 is in communication with an input 80 of the AM/FM receiver 28 through the electrical connection 50. The AM/FM receiver 28 is a radio head unit including an AM/FM tuner 82 to switch between AM and FM radio broadcasts, and may also include sound processing circuitry, signal processing circuits, and one or more media players such as, for example, a CD player or an MP3 player. The AM/FM receiver 28 also includes an output 84 in communication with the AM/FM switching amplifier 68 through an output line 86, where the output line 86 can be either a data network or a direct signal wire. When a user switches between an AM and an FM broadcast using the AM/FM tuner 82, the AM/FM receiver 28 sends a data signal through the output line 86 to the AM/FM antenna amplifier 68.

The AM/FM antenna amplifier 68 includes circuitry or control logic (not shown) for detecting the output of the AM/FM tuner 82. The circuitry or control logic instructs the antenna selecting circuit 72 to switch between the AM or the FM signal based on the output of the AM/FM tuner 82. For example, if a user selects an FM broadcast using the AM/FM tuner 82, the switch 76 of the antenna selecting circuit 72 connected to the input terminal of the AM signal 78 will be switched to an off position, while the switch 74 connected to the input terminal of the FM signal 79 will switch to an on position. The FM signal is then transmitted from the selecting circuit 72 to the amplifier 74, and to the AM/FM receiver 28 for reception. A user can also further select a specific radio broadcast channel within the RF operating band (i.e., between 87.7 megahertz to 108 megahertz for FM reception) by using the AM/FM tuner 82.

FIG. 4 is an alternative embodiment of a diversity antenna system 120 including an antenna element 122, two buffer modules 168, and an AM/FM receiver 128. The AM/FM receiver 128 is integrated with a diversity combiner 166 combining the first and second signals from FM feed points 154 into a single antenna signal, as well as an antenna selecting circuit 172. Each of the FM feed points 154 allow for the acquisition of a separate FM RF signal, where a first signal corresponds with one of the FM electrical feed points 154, and a second signal corresponds with the other FM electrical feed point 154. An AM feed point 162 also allows for the acquisition of a separate AM signal as well.

In the embodiment as illustrated, one of the FM feed points 154 and the AM feed point 162 are connected to one of the buffer modules 168, and the output of the other FM feed point 154 is connected to the other buffer module 168 by an electrical connection 150. The buffer modules 168 typically include antenna amplifying circuitry that increases the signal strength of the first and second FM signals from the FM electrical feed points 154 as well as the AM feed point 162. Each of the buffer modules 168 are in communication with an input 180 of the AM/FM receiver 128 through the electrical connection 150, where the first and second signals from the FM feed points 154 are sent to the input 180. The input 180 is connected to the diversity combiner 166, which combines the first and second FM signals into a single antenna signal. The AM signal from the AM feed point 162 is sent to the antenna selecting circuit 172.

The antenna selecting circuit 172 includes two switches 176 that are applied to respective input terminals 178, 179 of the AM and FM signals and selects one of the AM and FM signals based upon the input from an AM/FM tuner 182 that switches between AM and FM radio broadcasts. For example, if a user selects an FM broadcast using the AM/FM tuner 182, the switch 176 of the antenna selecting circuit 172 connected to the input terminal of the AM signal 178 will be switched to an off position, while the switch 176 connected to the input terminal of the FM signal 179 will switch to an on position. The FM signal is then transmitted from the selecting circuit 172 for reception.

Referring generally to FIGS. 1A-4, the diversity antenna system 20 provides a single antenna signal that has better reception quality than any individual antenna system. At least most types of antenna diversity systems that are currently available employ several different antenna elements for receiving RF signals. However, having multiple antennas visible on the exterior of a vehicle can cause styling issues. In contrast, the diversity antenna system 20 and 120 employs a single antenna element 22 and 122 for receiving multiple RF signals. Moreover, the antenna element 22 and 122 can be placed along the length of the spoiler, the cowl lip, the front fascia or the rear fascia of a vehicle. This positioning on the vehicle allows the antenna element 22 and 122 to be less noticeable and more aesthetically pleasing than some other types of automotive antennas such as, for example, whip antennas.

The description of the invention is merely exemplary in nature and variations that do not depart from the gist of the invention are intended to be within the scope of the invention. Such variations are not to be regarded as a departure from the spirit and scope of the invention.

What is claimed is:

1. An antenna configured to mount to a surface, comprising:

a electrical half wave monopole antenna element fixedly attached to the surface, wherein the antenna element includes an electrical center;

a first electrical feed point located on a first side of the antenna element; and a second electrical feed point located on a second side of the antenna element, wherein the second side generally opposes the first side of the antenna element, and wherein the first and second electrical feed points are located about one-twentieth a wavelength from the electrical center, and wherein a first signal corresponds with the first electrical feed point and a second signal corresponds with the second electrical feed point, and the first signal is out of phase when compared to the second signal.

2. The antenna of claim 1 wherein the phase difference between the first signal and the second signal is about ninety degrees.

3. The antenna of claim 1 wherein the antenna element includes a third electrical feed point that is located at about the electrical center of the antenna element.

4. The antenna of claim 2 wherein the first electrical feed point and the second electrical feed point are FM feed ports and the third electrical feed point is an AM feed point.

5. The antenna of claim 1 wherein the antenna element is configured to be affixed to one of a rear spoiler, a cowl lip, and a fascia of a vehicle.

6. The antenna of claim 1 wherein the electrical center of the antenna element is located at about a midpoint of the antenna element, and the electrical center is also a mechanical center of the antenna element.

7. A diversity antenna system, comprising:

an electrical half wave monopole antenna element fixedly attached to a surface, the antenna element comprising:

an electrical center;

a first electrical feed point located on a first side of the antenna element; and a second electrical feed point located on a second side of the antenna element, wherein the second side generally opposes the first side of the antenna element, and wherein the first and second electrical feed points are located about one-twentieth a wavelength from the electrical center, wherein a first signal corresponds with the first electrical feed point and a second signal corresponds with the second electrical feed point, and the first signal is out of phase when compared to the second signal; and a diversity combiner in communication with both of the first signal and the second signal, wherein the diversity combiner combines the first signal and the second signal together to create a single antenna signal.

8. The diversity antenna system of claim 7 wherein the single antenna signal is created by selecting a maximum gain value between the first signal and the second signal, wherein the single antenna signal includes the maximum gain value.

9. The diversity antenna system of claim 7 wherein the phase difference between the first signal and the second signal is about ninety degrees.

10. The diversity antenna system of claim 7 wherein the antenna element includes a third electrical feed point that is located at about the electrical center of the antenna element.

11. The diversity antenna system of claim 9 wherein the first electrical feed point and the second electrical feed point are FM feed ports that correspond with an FM signal, and the third electrical feed point is an AM feed point that corresponds with an AM signal.

12. The diversity antenna system of claim 11 wherein the diversity combiner is in communication with an antenna amplifier that selects one of the AM signal and the FM signal.

13. The diversity antenna system of claim 12 wherein the antenna amplifier is in communication with an AM/FM receiver.

14. The diversity antenna system of claim 7 wherein the diversity combiner is integrated with an AM/FM receiver.

15. The diversity antenna system of claim 7 wherein the AM/FM receiver includes an antenna selection circuit.

16. A diversity antenna system, comprising:

an electrical half wave monopole antenna element fixedly attached to a surface, the antenna element comprising:

an electrical center;

a first FM feed point located on a first side of the antenna element; and a second FM feed point located on a second side of the antenna element, wherein the second side generally opposes the first side of the antenna element, and wherein the first and second FM feed points are located about one-twentieth a wavelength from the electrical center, wherein a first signal corresponds with the first FM feed point and a second signal corresponds with the second FM feed point, and the first signal is out of phase by ninety degrees when compared to the second signal; and a diversity combiner in communication with both of the first signal and the second signal, wherein the diversity combiner combines the first signal and the second signal together to create a single antenna signal.

17. The diversity antenna system of claim 16 wherein the single antenna signal is created by selecting a maximum gain value between the first signal and the second signal, wherein the single antenna signal includes the maximum gain value.

18. The diversity antenna system of claim 16 wherein the antenna element includes a third electrical feed point that is located at about the electrical center of the antenna element.

19. The diversity antenna system of claim 17 wherein the third electrical feed point is an AM feed point that corresponds with an AM signal.

20. The diversity antenna system of claim 19 wherein the diversity combiner is in communication with a switching amplifier that selects one of the AM signal and the FM signal.

* * * * *